US009565901B2

(12) United States Patent
Chen

(10) Patent No.: US 9,565,901 B2
(45) Date of Patent: Feb. 14, 2017

(54) SHOE TOE SHAPING CLAMPING DEVICE

(71) Applicant: True Ten Industrial Co., Ltd., Taichung (TW)

(72) Inventor: Chien-Cheng Chen, Taichung (TW)

(73) Assignee: True Ten Industrial Co., Ltd., Taichung (TW)

( * ) Notice: Subject to any disclaimer, the term of this patent is extended or adjusted under 35 U.S.C. 154(b) by 379 days.

(21) Appl. No.: 14/247,296

(22) Filed: Apr. 8, 2014

(65) Prior Publication Data

US 2015/0282568 A1 Oct. 8, 2015

(51) Int. Cl.

| | |
|---|---|
| ***A43D 25/14*** | (2006.01) |
| ***A43D 43/00*** | (2006.01) |
| ***A43D 21/00*** | (2006.01) |
| ***A43D 25/00*** | (2006.01) |
| ***A43D 11/12*** | (2006.01) |

(52) U.S. Cl.

CPC ..... *A43D 11/12* (2013.01)

(58) Field of Classification Search

CPC .... A43D 11/12; A43D 21/166; A43D 21/122; A43D 21/12; A43D 21/10; A43D 13/02; A43D 15/02; A43D 15/00; B25B 11/02; B25B 11/00

USPC ..... 12/64, 7.5, 12.2, 12.4, 123, 125,12/54.1–54.2, 61 R; 269/55–60, 71, 271, 291; 425/193–195

See application file for complete search history.

(56) References Cited

U.S. PATENT DOCUMENTS 2,212,552 A * 8/1940 Rohrer ..... A43D 113/00 12/12

5,862,554 A * 1/1999 Lu ..... A43D 11/12 12/11.3

* cited by examiner

*Primary Examiner* — Anna Kinsaul
*Assistant Examiner* — Timothy K Trieu
(74) *Attorney, Agent, or Firm* — Alan D. Kamrath; Kamrath IP Lawfirm, P.A.

(57) ABSTRACT

A shoe toe shaping clamping device has a mold base and multiple clamping units. The mold base has a mold body. Each clamping unit has a clamping base, a bottom clamping unit, a top clamping unit, a clamping space, and a depth adjusting unit. The bottom clamping unit is mounted on the clamping base, is adjacent to the mold body, and has a bottom clamping surface. The top clamping unit is mounted on the clamping base and has a top clamping surface. The clamping space is formed between the top clamping surface and the bottom clamping surface. The depth adjusting unit is mounted on the bottom clamping unit and shelters two sides of the clamping space. The shoe toe shaping clamping device is applied for clamping a vamp to form a shoe toe.

6 Claims, 10 Drawing Sheets

SHOE TOE SHAPING CLAMPING DEVICE

BACKGROUND OF THE INVENTION

1. Field of the Invention

The present invention relates to a clamping device and, more particularly, to a shoe toe shaping clamping device.

2. Description of Related Art

A conventional shoe toe shaping clamping device has a mold base and multiple clamping bases. The mold base is formed in the shape of a shoe tree. The clamping bases surround the mold base. Each clamping base has a bottom base and a top base. The top base can be moved longitudinally relative to the bottom base. A curved abutment status is formed between the top base and the bottom base.

In use, a middle of a vamp is placed on the mold base. A periphery of the vamp is placed between the top bases and the bottom bases. The top bases and the bottom bases clamp the periphery of the vamp, such that the vamp can be formed as a shoe toe due to the curved abutment status between the top base and the bottom base.

However, the positions of the clamping bases cannot be adjusted relative to the mold base, such that the conventional shoe toe shaping clamping device cannot be applied for vamps of different sizes.

SUMMARY OF THE INVENTION

The main objective of the present invention is to provide a shoe toe shaping clamping device to resolve the aforementioned problems.

The shoe toe shaping clamping device has a mold base, a fixing plate and multiple clamping units.

The mold base has a mold body.

The fixing plate is mounted on the mold base.

The clamping units are mounted on the fixing plate and around the mold base, and each clamping unit has a clamping base, a bottom clamping unit, a top clamping unit, a clamping space, and a depth adjusting unit. The bottom clamping unit is mounted on the clamping base, is adjacent to the mold body, and has a bottom clamping surface formed on a top of the bottom clamping unit. The top clamping unit is mounted on the clamping base and has a top clamping surface formed on a bottom of the top clamping unit. The clamping space is formed between the top clamping surface and the bottom clamping surface. The depth adjusting unit is mounted on the top clamping unit and has an adjusting body and two block units. The adjusting body is mounted on the top clamping unit at a position opposite to the mold body, and the two block units are respectively connected with two sides of the adjusting body and respectively sheltering two sides of the clamping space.

Other objectives, advantages and novel features of the present invention will become more apparent from the following detailed description when taken in conjunction with the accompanying drawings.

DETAILED DESCRIPTION OF PREFERRED EMBODIMENTS

Figure 1:
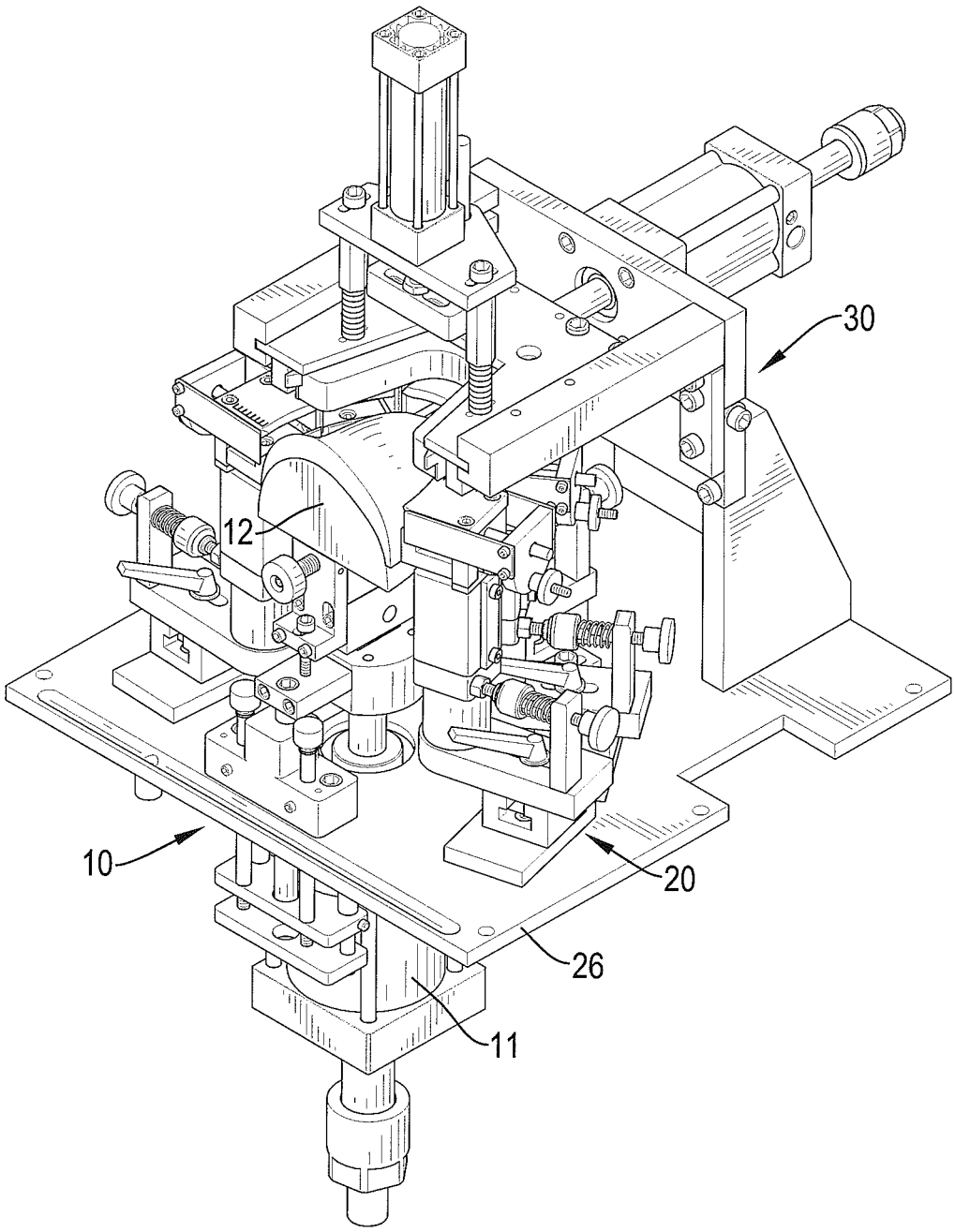
FIG. 1 is a perspective view of a preferred embodiment of a shoe toe shaping clamping device in accordance with the present invention combined with a mold clamping unit.
Figure 2:
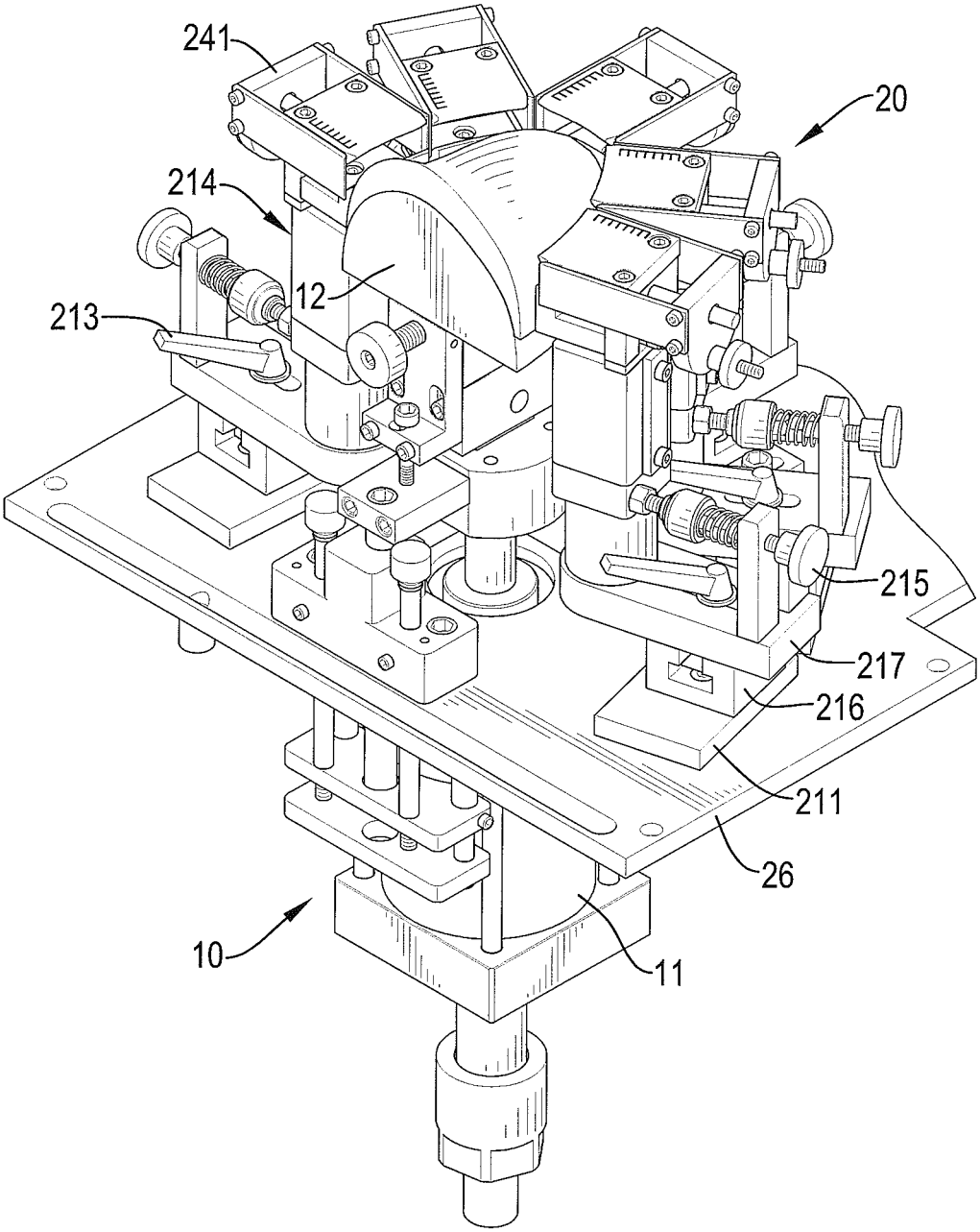
FIG. 2 is a perspective view of the shoe toe shaping clamping device in FIG. 1.

With reference to FIGS. 1 and 2, a preferred embodiment of a shoe toe shaping clamping device in accordance with the present invention has a mold base 10, a fixing plate 26, and multiple clamping units 20.

The mold base 10 has a mold bottom base 11 and a mold body 12. The mold body 12 is formed in the shape of a shoe tree and is mounted on the mold bottom base 11. In use, a mold clamping unit 30 is mounted on the mold body 12 to selectively abut the mold body 12 to clamp a vamp disposed between the mold body 12 and the mold clamping unit 30.

With reference to FIGS. 3 to 6, the fixing plate 26 is mounted on the mold bottom base 11.

A number of the clamping units 20 may be five. The clamping units 20 are mounted on the fixing plate 26 and around the mold base 10. Each clamping unit 20 has a clamping base 21, a bottom clamping unit 22, a top clamping unit 23, and a depth adjusting unit 24.

Figure 3:
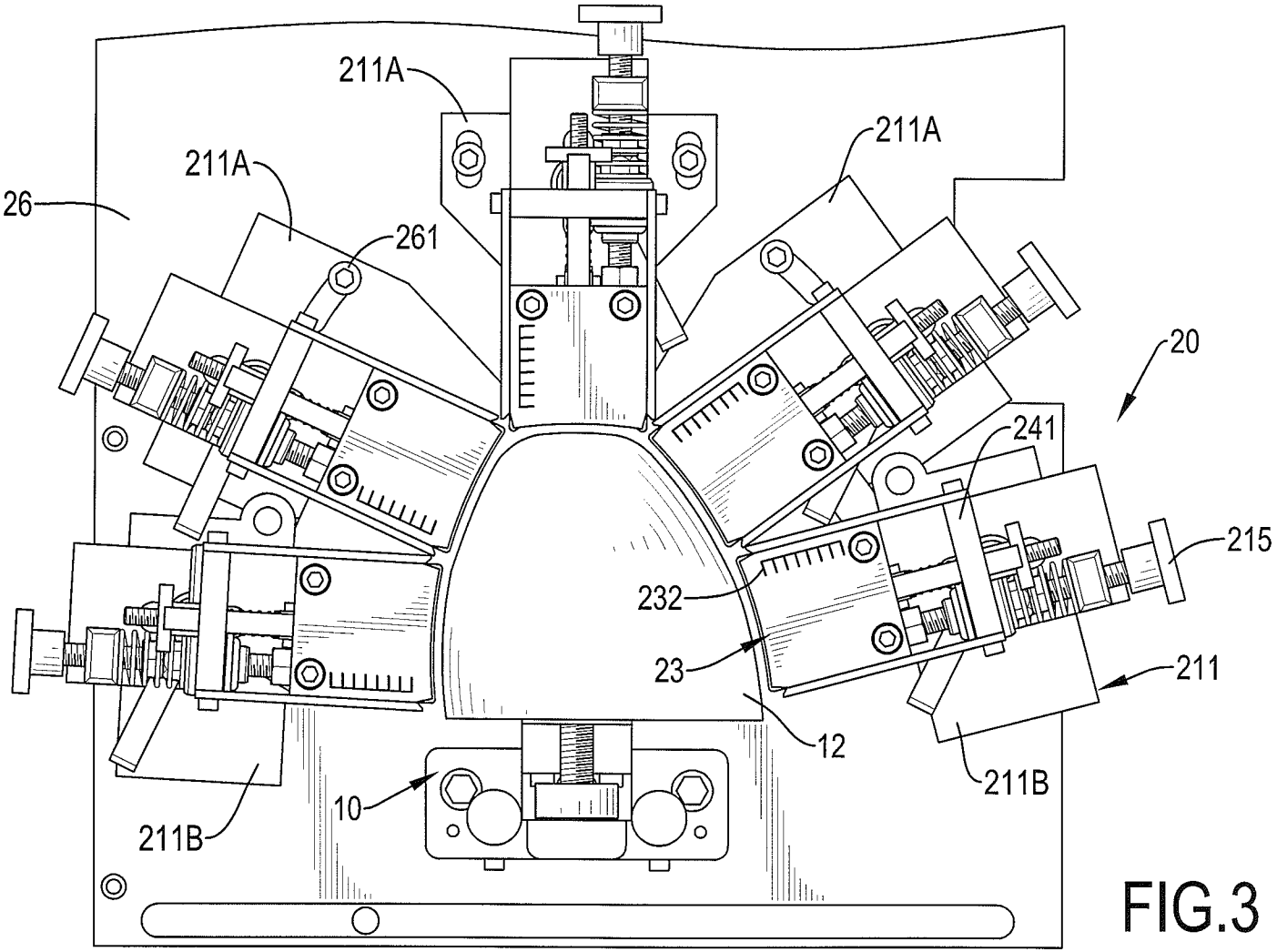
FIG. 3 is a top view of the shoe toe shaping clamping device in FIG. 1.
Figure 7:
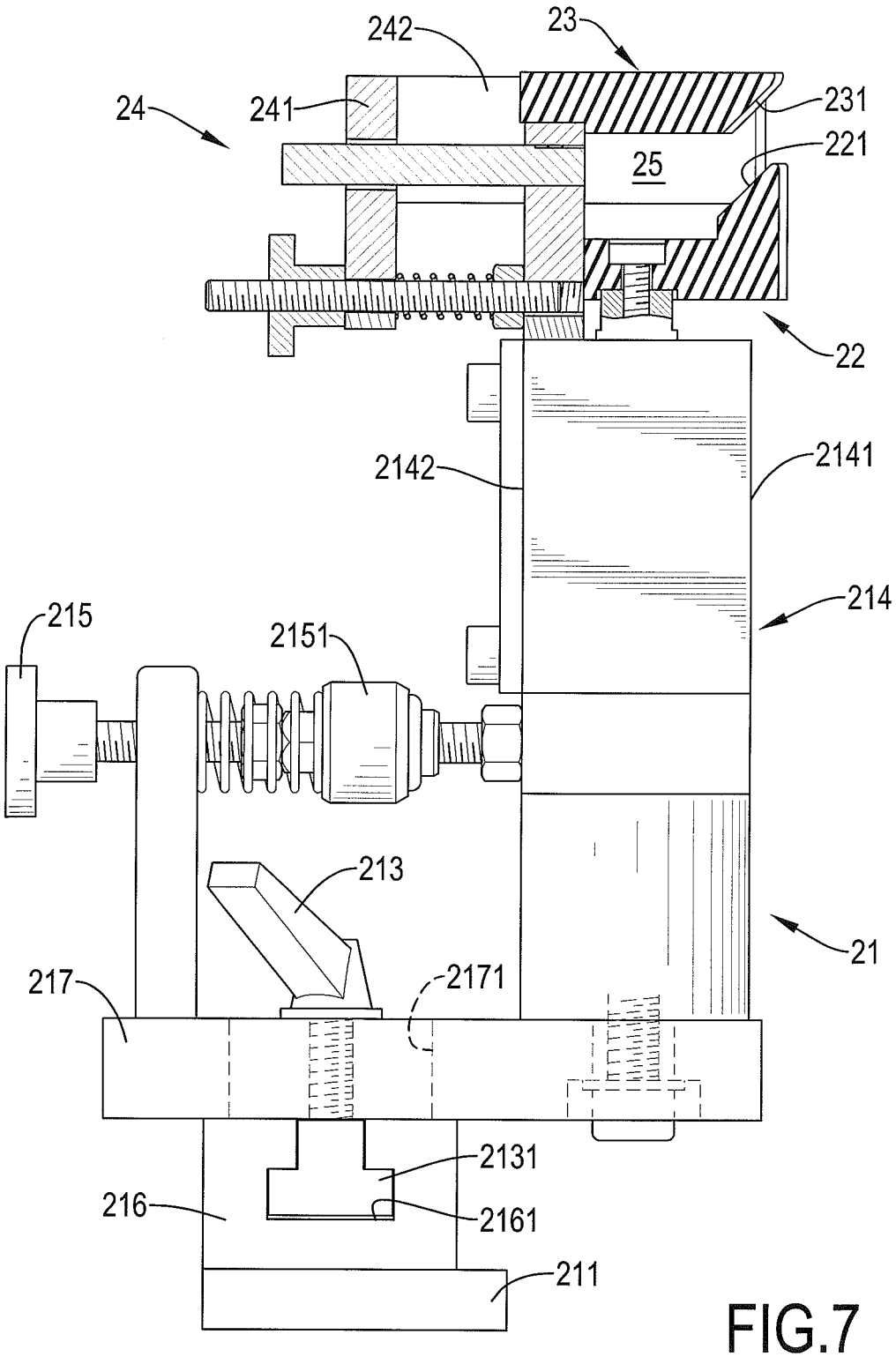
FIG. 7 is a side view in partial section of the clamping unit in FIG. 4.

With reference to FIGS. 3 and 7, each clamping base 21 has a bottom plate 211, a base body 212, a sliding control unit 213, a supporting base 214, and a rotating control unit 215.

With reference to FIG. 3, the bottom plates 211 are mounted on the fixing plate 26. Three of the bottom plates are first bottom plates 211A, and the other two bottom plates are second bottom plates 211B. The first bottom plates 211A are adjustably mounted on the fixing plate 26. Preferably, the first bottom plates 211A are mounted on the fixing plate 26 by multiple fixing units 261, such that the positions of the first bottom plates 211A can be adjusted relative to the fixing plate 26 by the fixing units 261. The second bottom plates 211B are respectively pivoted on a corresponding adjacent first bottom plate 211A, such that the positions of the second bottom plates 211B can be adjusted relative to the corresponding first bottom plates 211A.

With reference to FIGS. 4 to 7, the base body 212 is mounted on the bottom plate 211 and has a bottom base 216 and a sliding base 217. The bottom base 216 is mounted on the bottom plate 211 and has a sliding track 2161 formed in a top side of the bottom base 216. The sliding base 217 abuts the bottom base 216 and has an adjusting hole 2171. The adjusting hole 2171 is elongated, is formed through the sliding base 217 and is aligned with the sliding track 2161. The sliding control unit 213 is inserted through the adjusting hole 2171 and is engaged with the sliding track 2161 by a sliding block 2131. The sliding control unit 213 can be selectively fixed relative to the base body 212. When the sliding control unit 213 is fixed relative to the base body 212, the sliding base 217 cannot slide relative to the bottom base 216. When the sliding control unit 213 is loosened relative to the base body 212 and can slide relative to the sliding track 2161, the sliding base 217 can slide relative to the bottom base 216. Furthermore, the sliding control unit 213 can be selectively engaged in the adjusting hole 2171. When the sliding control unit 213 is not engaged in the adjusting hole 2171, the sliding base 217 can slide along the adjusting hole 2171.

The supporting base 214 is rotatably mounted on the sliding base 217 and is located at an end of the sliding base 217 at a position adjacent to the mold base 10. The supporting base 214 has a first side 2141 and a second side 2142. The first side 2141 is adjacent to the mold base 10, and the second side 2142 is opposite to the mold base 10. The rotating control unit 215 is mounted on the sliding base 217 at a position opposite to the supporting base 214. The rotating control unit 215 can be rotated relative to the sliding base 217 and has a rotating control joint 2151 combined with the second side 2142 of the supporting base 214. When the rotating control unit 215 is rotated relative to the sliding base 217, the rotating control joint 2151 can drive the supporting base 214 to rotate relative to the sliding base 217.

The bottom clamping unit 22 is moveably mounted on the supporting base 214, and the bottom clamping unit 22 can be longitudinally moved relative to the supporting base 214. The bottom clamping unit 22 has a bottom clamping surface 221 which is curved and formed on a top of the bottom clamping unit 22. The top clamping unit 23 is mounted on the supporting base 214 and has a top clamping surface 231 and multiple scale graduations 232. The top clamping surface 231 is curved, is formed on a bottom of the top clamping unit 23, and is selectively abutted by the bottom clamping surface 221. The curved bottom clamping surface 221 and the curved top clamping surface 231 match each other in curvature. The scale graduations 232 are formed on a top side of the top clamping unit 23 at intervals, and are arranged along a direction from the first side 2141 to the second side 2142 of the supporting base 214. The clamping space 25 is formed between the bottom clamping surface 221 and the top clamping surface 231.

The depth adjusting unit 24 is mounted on the top clamping unit 23 and has an adjusting body 241 and two block units 242. The adjusting body 241 is moveably mounted on the top clamping unit 23. The block units 242 are respectively connected with two sides of the adjusting body 241 and respectively shelter two sides of the clamping space 25.

Figure 4:
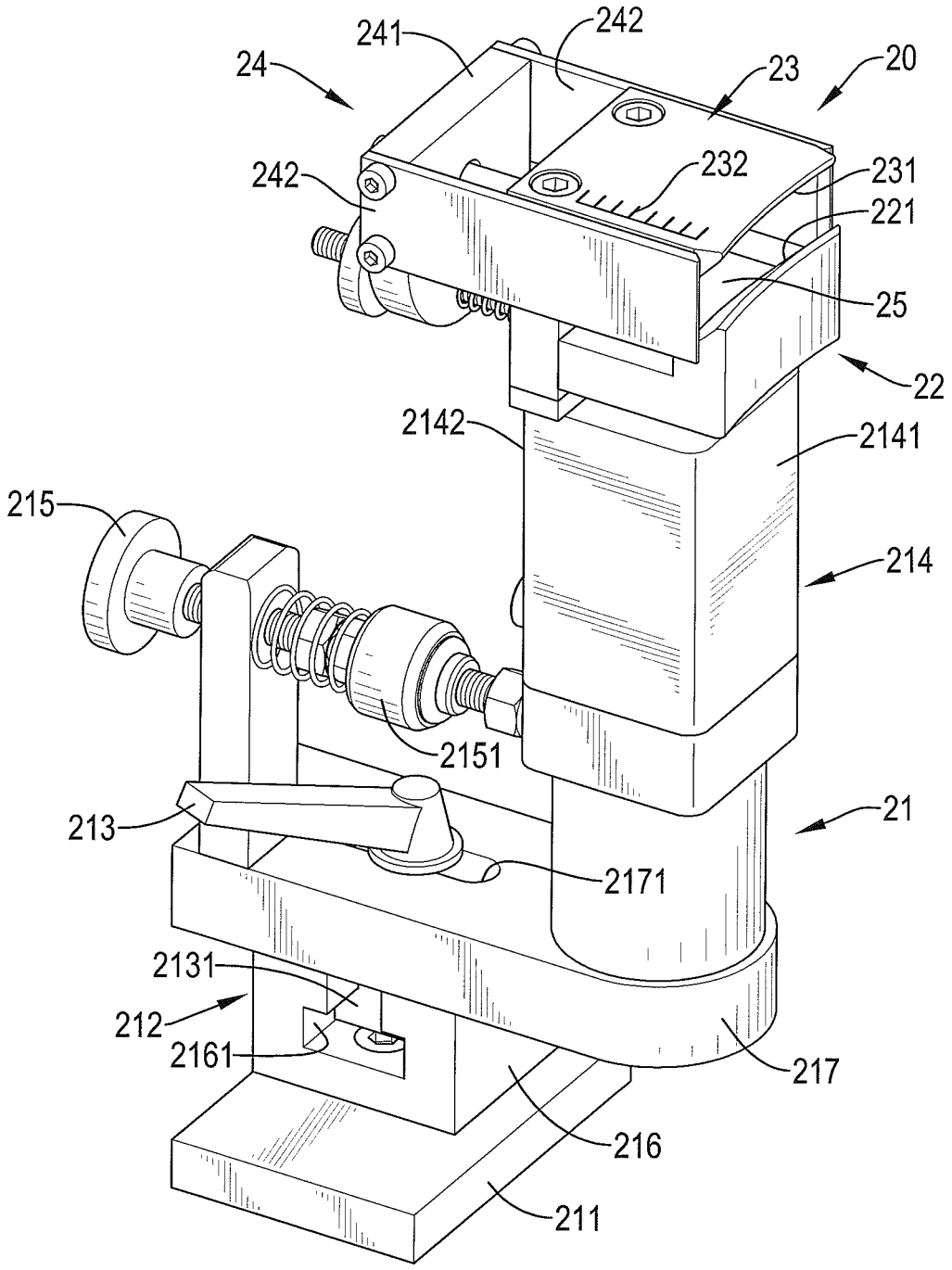
FIG. 4 is perspective view of a clamping unit in FIG. 1.
Figure 5:
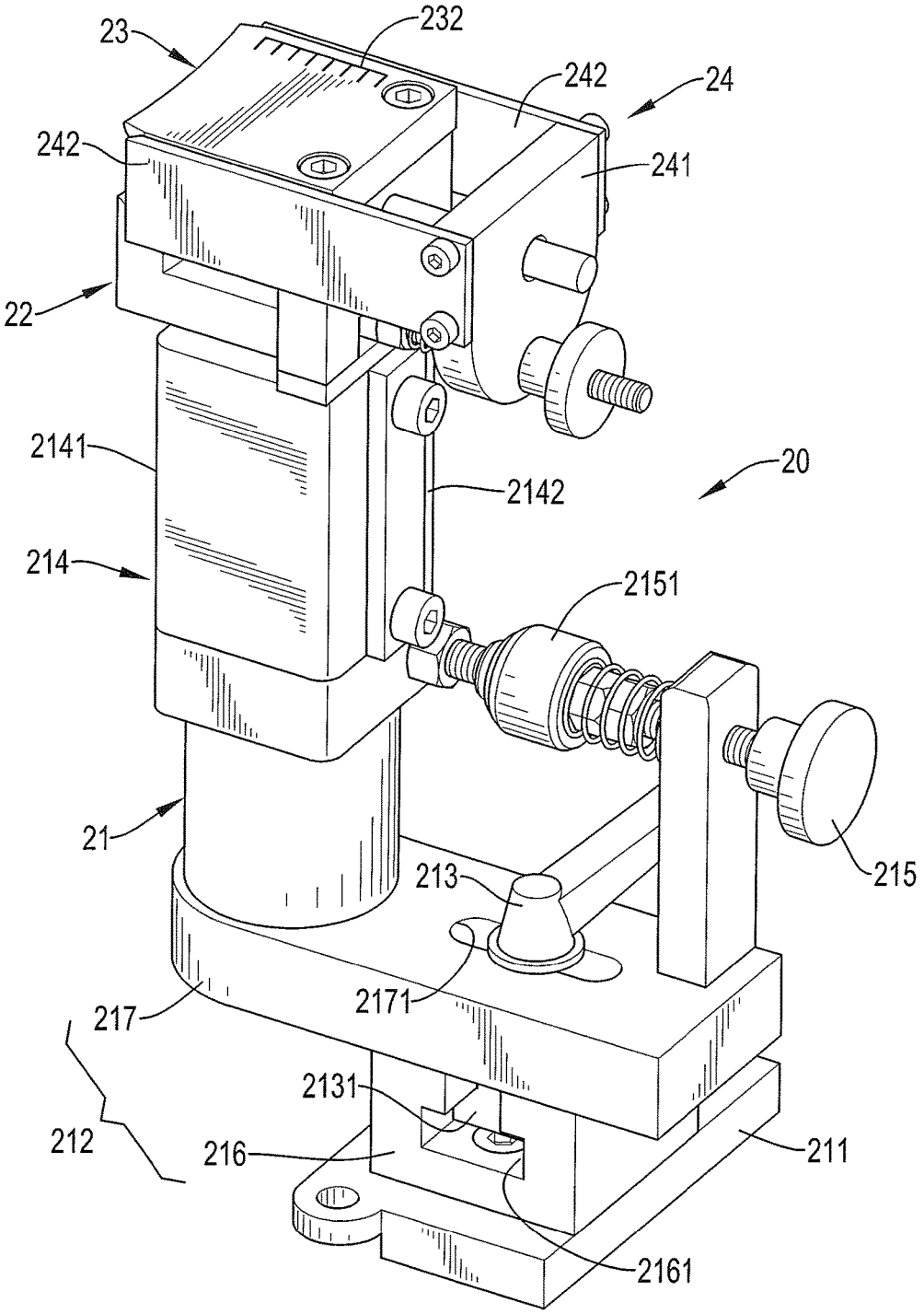
FIG. 5 is another perspective view of the clamping unit in FIG. 4.
Figure 6:
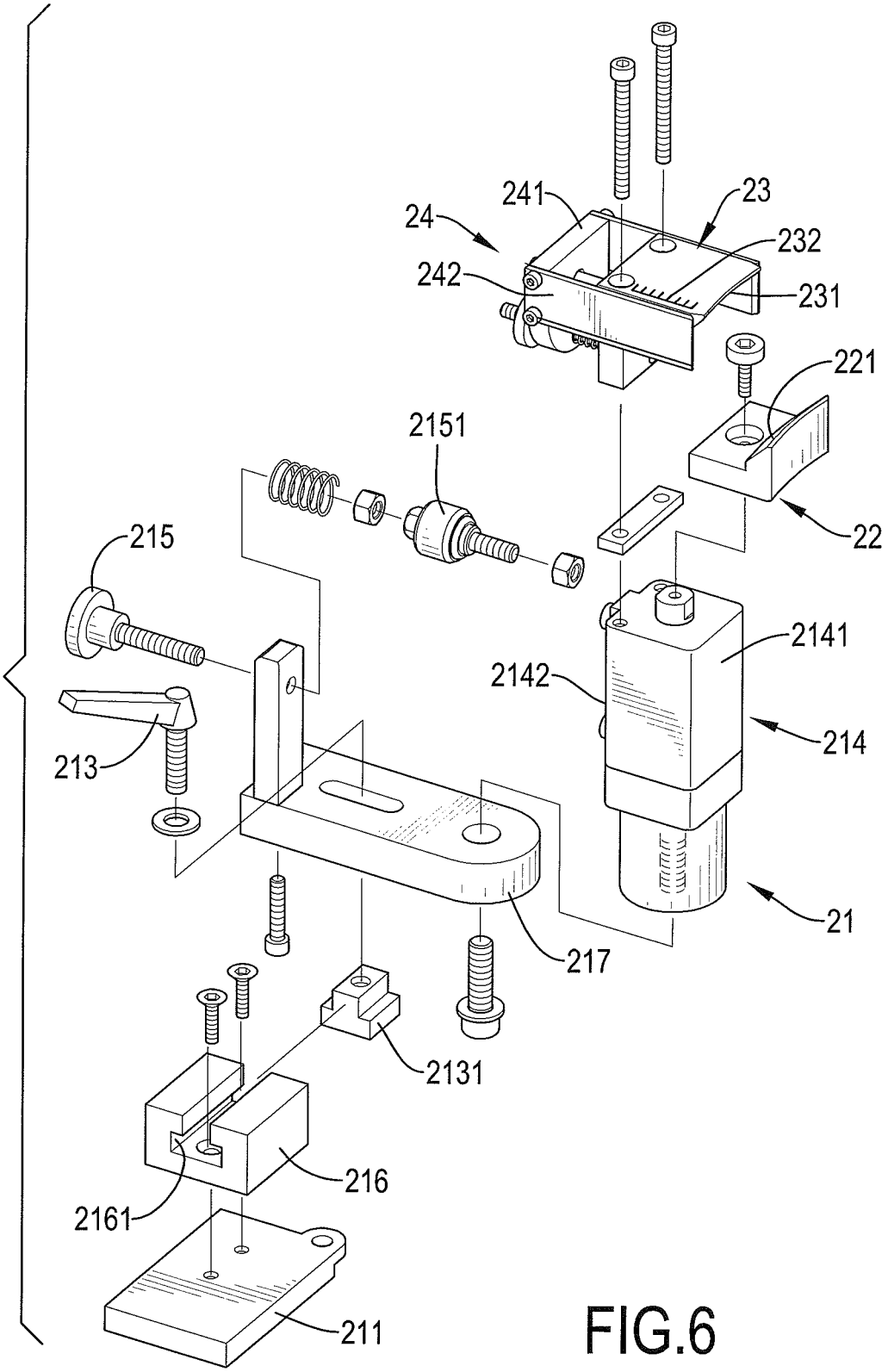
FIG. 6 is an exploded perspective view of the clamping unit in FIG. 4.

With reference to FIGS. 2 and 4, in use, a vamp is mounted on the mold body 12 and in the clamping spaces 25. The top clamping units 23 and the bottom clamping units 22 clamp the vamp, such that the vamp can be formed into a shoe toe shape. The adjusting process of the clamping units 20 is described as follows.

Figure 8:
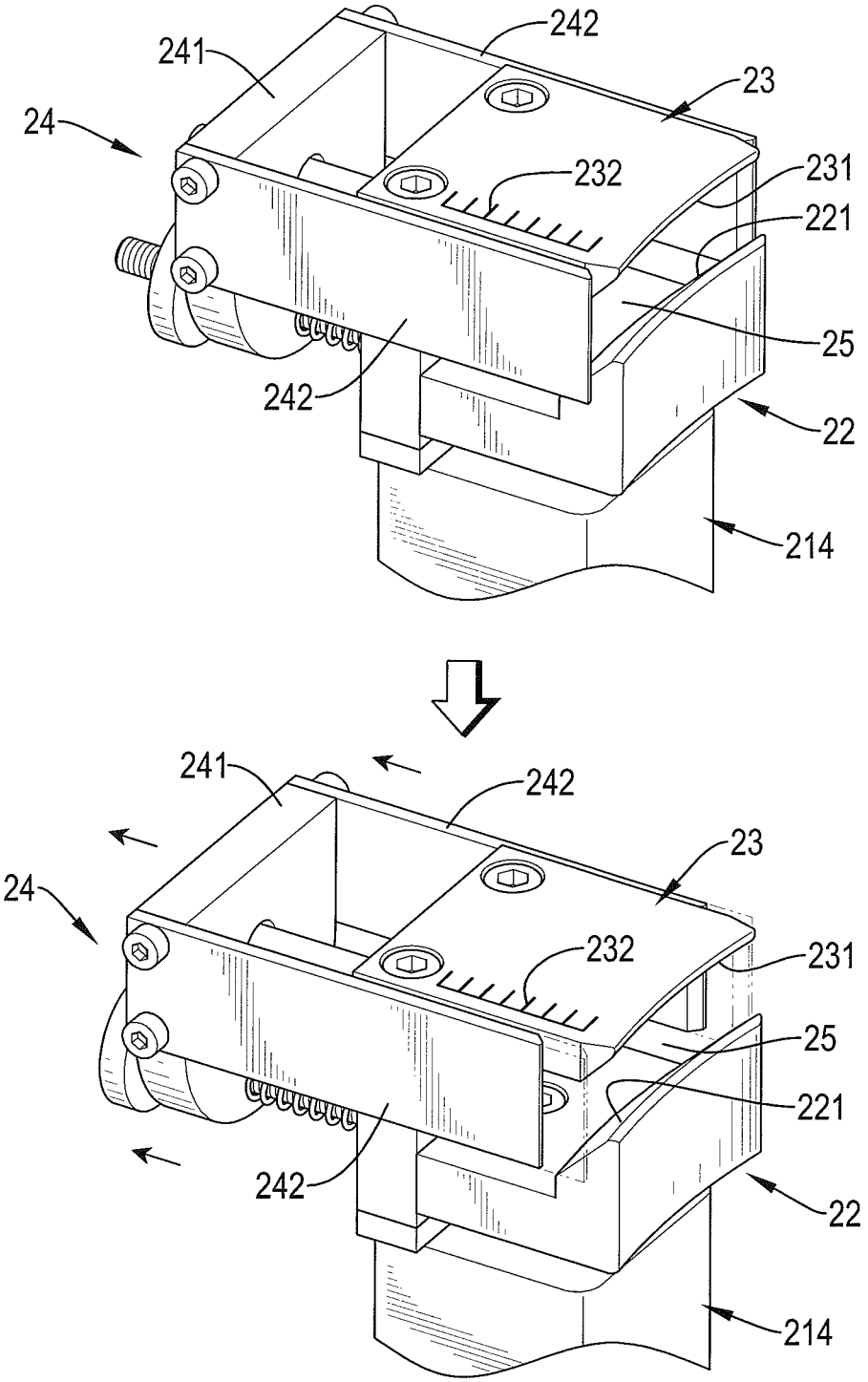
FIG. 8 is an operational perspective view of the clamping unit in FIG. 4.

With reference to FIG. 8, the depth adjusting unit 24 can adjust a front-rear position of the block units 242 relative to the top clamping unit 23. When the adjusting body 241 moves opposite to the top clamping unit 23, the block units 242 also move rearward opposite to the top clamping unit 23. A user can determine an adjusting distance of the adjusting body 241 relative to the top clamping unit 23 according to the scale graduations 232. When the block units 242 move rearward relative to the top clamping unit 23, a depth of the clamping space 25 is increased, and an area of the vamp that is put into the clamping space 25 is increased.

Figure 9:
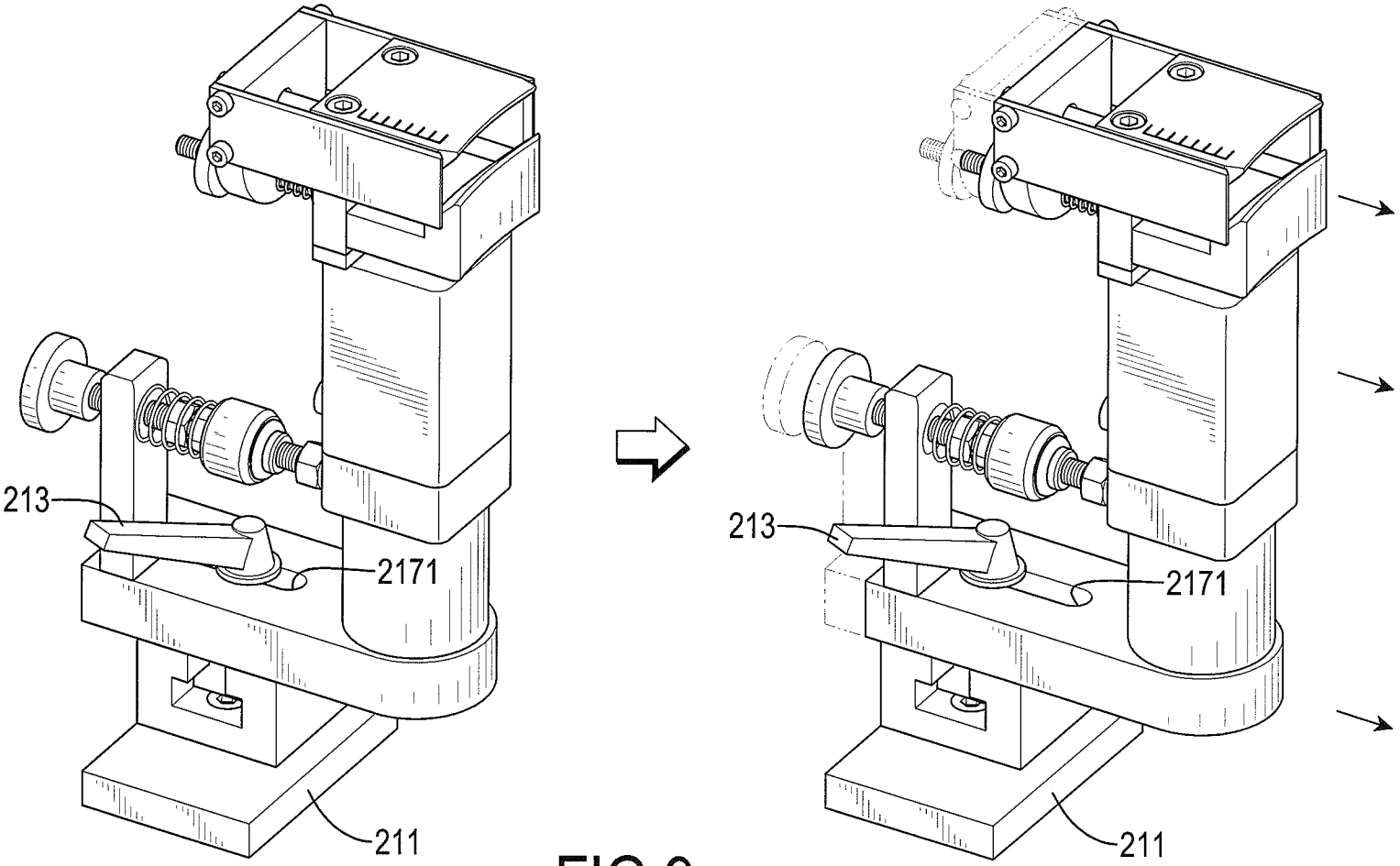
FIG. 9 is an operational perspective view of the clamping unit in FIG. 4.
Figure 10:
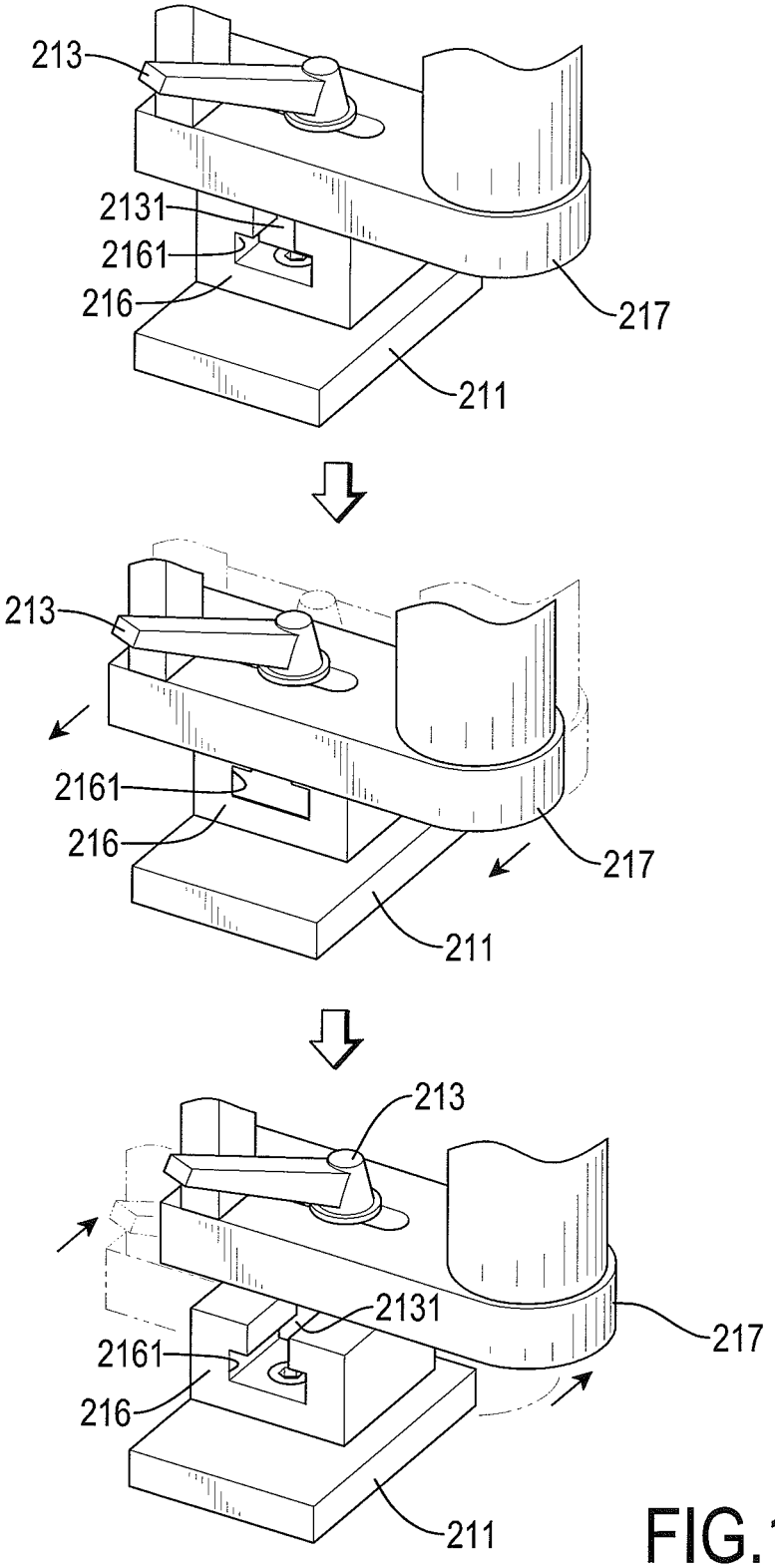
FIG. 10 shows operational perspective views of the clamping unit in FIG. 4.

With reference to FIGS. 9 and 10, the sliding control unit 213 can control the sliding base 217 to slide. When the sliding control unit 213 is loosened, the sliding base 217 can move frontward or rearward relative to the sliding control unit 213 along the adjusting hole 2171. Furthermore, the sliding control unit 213 can slide rightward or leftward relative to the sliding track 2161 by the sliding control unit 213.

The rotating control unit 215 can be rotated relative to the sliding base 217. When the rotating control unit 215 is rotated relative to the sliding base 217, the supporting base 214 can be driven to rotate the sliding base 217 by the rotating control joint 2151, such that a placement angle of the top clamping unit 23 and the bottom clamping unit 22 can be adjusted relative to the mold body 12.

From the above description, it is noted that the present invention has the following advantages:

1. The depth adjusting unit 24 can adjust the front-rear position of the block units 242 relative to the top clamping unit 23. When the block units 242 move rearward or frontward relative to the top clamping unit 23, the clamping space 25 can be adjusted to mold vamps of different sizes.

2. The scale graduations can assist the user with determining the position of the block units 242 relative to the top clamping unit 23.

3. The rotating control unit 215 can control the supporting base 214 to rotate relative to the sliding base 217 to control the placement angle of the top clamping unit 23 and the bottom clamping unit 22 relative to the mold body 12. The sliding control unit 213 can be loosened or fixed, such that the sliding base 217 can slide rightward or leftward relative to the bottom base 216. Therefore, the position of the sliding base 217 can also be adjusted. The bottom plates 211 are selectively moveably mounted on the fixing plate 26, such that the position of the bottom plates 211 can be adjusted according to molds of different sizes.

Even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A shoe toe shaping clamping device having:
- a mold base having a mold body;
- a fixing plate mounted on the mold base; and
- multiple clamping units mounted on the fixing plate and around the mold base, with each clamping unit having:
  - a clamping base;
  - a bottom clamping unit mounted on the clamping base, with the bottom clamping unit being adjacent to the mold body and having a bottom clamping surface formed on a top of the bottom clamping unit;
  - a top clamping unit mounted on the clamping base and having a top clamping surface formed on a bottom of the top clamping unit;
  - a clamping space formed between the top clamping surface and the bottom clamping surface; and
  - a depth adjusting unit mounted on the top clamping unit and having:
    - an adjusting body mounted on the top clamping unit; and
    - two block units respectively connected with two sides of the adjusting body and respectively sheltering two sides of the clamping space.

2. The shoe toe shaping clamping device as claimed in claim 1, wherein each top clamping unit further has multiple scale graduations formed on a top of the top clamping unit.

3. The shoe toe shaping clamping device as claimed in claim 2, wherein each clamping base has:

a bottom plate mounted on the fixing plate;

a base body mounted on the bottom plate;

a supporting base mounted on the base body, wherein the bottom clamping unit is mounted on the supporting base; and a rotating control unit mounted on the base body and having a rotating control joint connected with the supporting base.

4. The shoe toe shaping clamping device as claimed in claim 3, wherein:

the base body has:

a bottom base; and a sliding base mounted on the bottom base and having an elongated adjusting hole formed through the sliding base; and each clamping base further has a sliding control unit inserted through the elongated adjusting hole and into the bottom base.

5. The shoe toe shaping clamping device as claimed in claim 4, wherein the bottom base has a sliding track formed in a top of the bottom base; and each sliding control unit has a sliding block selectively moveable and engaged with the sliding track.

6. The shoe toe shaping clamping device as claimed in claim 5, wherein the bottom plates of the multiple clamping units are selectively and moveably mounted on the fixing plate.

* * * * *